United States Patent [19]

Moss et al.

[11] 4,043,741

[45] Aug. 23, 1977

[54] BURNER EQUIPMENT AND OPERATION THEREOF

[75] Inventors: Gerald Moss, Oxford; Graham Lloyd Johnes, Wantage; John William Thomas Craig, East Hendred, all of England

[73] Assignee: The United States of America as represented by the Administrator, Environmental Protection Agency, Washington, D.C.

[21] Appl. No.: 665,831

[22] Filed: Mar. 11, 1976

[30] Foreign Application Priority Data

Mar. 12, 1975 United Kingdom ..... 10277/75

[51] Int. Cl.[2] ..... F23J 7/00

[52] U.S. Cl. ..... 431/3; 431/32; 431/121; 431/186; 431/189

[58] Field of Search ..... 431/3, 121, 32, 186, 431/189

[56] References Cited

U.S. PATENT DOCUMENTS 2,605,708 8/1952 Smedes ..... 431/3 X

FOREIGN PATENT DOCUMENTS 218,466 1/1958 Australia ..... 431/121

44,541 11/1934 France ..... 431/121

*Primary Examiner*—Edward G. Favors

[57] ABSTRACT

Fuel gas produced e.g. in a fluid bed gasifier and which comprises deposit-forming materials such as heavy hydrocarbons (e.g. tars) and non-combustible fines is passed via conduits and solid-removing cyclones to a burner for admixture with air and subsequent combustion. Deposits formed in the conduits cyclones and burner are removed by closing off the burner outlet and air inlet, and passing a deposit-removing reactant (e.g. air) into the conduit to oxidize and thereby remove deposits, particularly from the cyclones. Preferably, there are at least two burners for the fuel gas, and they are closed off alternately to remove deposits from their respective conduits and cyclones.

27 Claims, 4 Drawing Figures

BURNER EQUIPMENT AND OPERATION THEREOF

Figure 1:
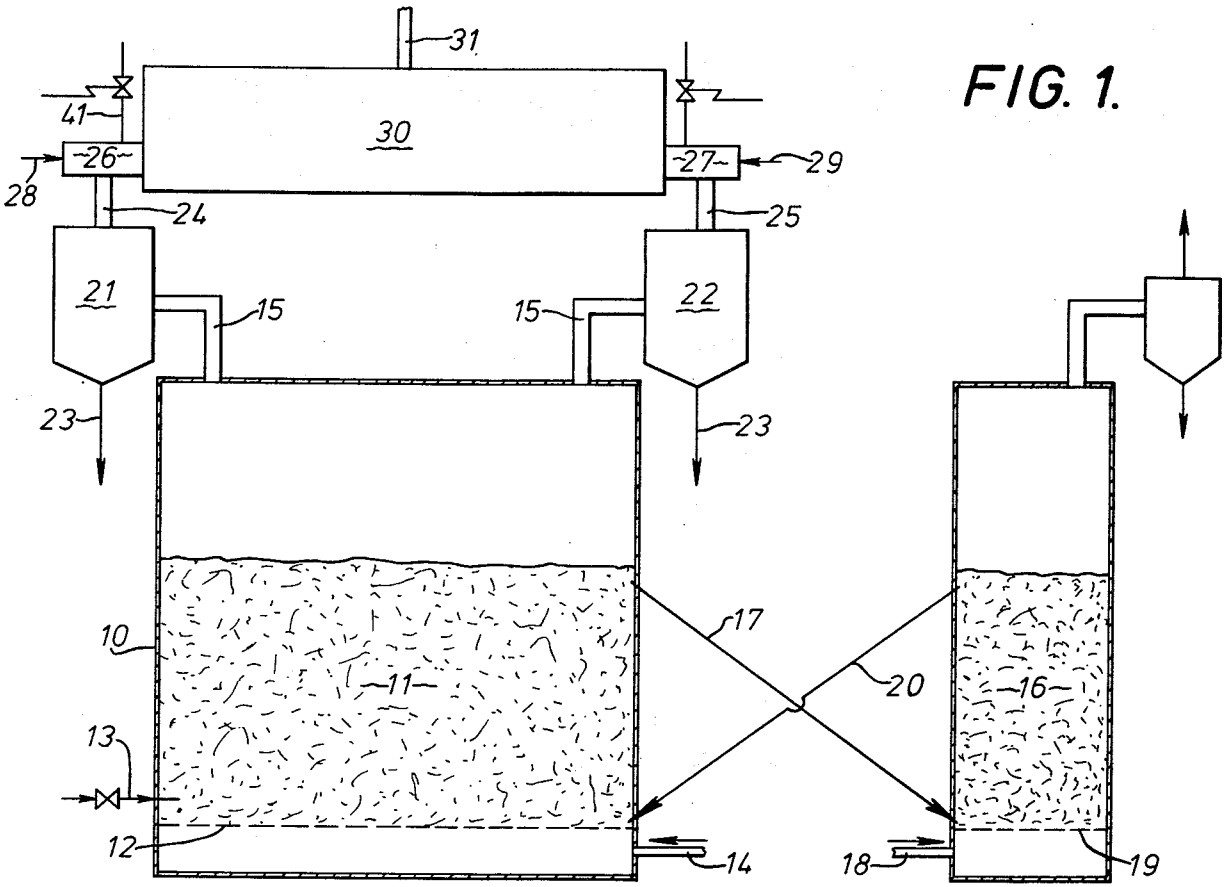

The invention described herein was made in the course of, or under, a contract with the United States Environmental Protection Agency.

The present invention relates to a method of operating, and apparatus for use in, or as part of, burner equipment.

Some fuels which are burned in burner equipment are apt to deposit tarry and carbonaceous materials in the ducts through which they are supplied to the burner equipment. Such fuels include particularly, but not exclusively, fuel gases produced by the part combustion or gasification of a source of fuel gases, such as a petroleum oil, or a solid fuel such as coal, or a semi-solid fuel such as tar or bitumen. The deposits impair the efficiency of use of the gasification and burner equipment since they build up and restrict the fuel gas flow to the burner equipment. Where this gas flow takes place through apparatus such as cyclones to remove coarser solids entrained in the gas, the build up of deposits can have a markedly adverse effect on overall plant performance. One way of removing the deposits from ducts and apparatus connected into the ducts is to shut down the gasification plant so that the ducts and associated apparatus can be physically decoked. However, this course is clearly disadvantageous, particularly when the gasification plant provides all, or a substantial proportion of, the fuel required for the normal operation of, e.g. a power station.

In one aspect of the present invention, fuel which tends to form deposits of, e.g. tarry material, coke and/or solids entrained in the fuel which adheres in such deposits is passed via at least two ducts to the burner equipment, and one duct at a time is obturated adjacent to the burner equipment, and a deposit-removing reactant passed into the obturated duct so that it flows through the obturated duct in a direction opposed to the normal direction of fuel flow and thereby substantially removes deposits therefrom.

Since the deposits will usually comprise carbon, or carbonaceous material, the deposit-removing reactant may be selected from oxygen-containing gas (e.g. air, diluted air or oxygen-enriched air), steam, carbon dioxide-containing gas (e.g. flue gas) or any mixture of the foregoing. The actual choice of the deposit-removing reactant will depend, inter alia, on the nature of the deposit and the temperature of the deposit at the beginning of the deposit-removing operations, and the maximum temperature which the ducts and associated apparatus can withstand. The products of the reaction between the deposit and the deposit-removing reactant may flow to the non-obturated duct and pass therethrough to the burner equipment. If the fuel is produced in a fuel gasifier, the reaction products will enter the non-obturated duct by way of the gasifier. A suitable gasifier may be of the type in which a normally liquid or solid fuel is converted to a hot combustible gas by part-combustion or gasification in a bed of hot fluidized solids. The hot fluidized solids may comprise sulphur-fixing materials (such as CaO) to fix sulphur from the fuel in the solids thereby to produce a substantially sulphur-free hot combustible gas.

In another aspect, the invention provides a method of removing deposits from fuel combustion equipment in which a fuel having a tendency to form deposits is passed from a source of the fuel to a plurality of fuel burners via flow paths comprising respective fuel conduits, comprising closing off the flow path of fuel gas to one burner at a time, and passing a deposit-removing reactant into the closed off flow path, in a direction opposite to the normal direction of flow of fuel, from a location adjacent to and upstream (relative to the normal fuel flow direction) of the position of closing off of the fuel flow path.

The fuel flow paths may comprise cyclones for removing solids from the hot combustible fuel gas, particularly when the gas has been generated by fuel gasification in a fluidized bed.

In a further aspect, the invention comprises apparatus for use as at least part of burner equipment for burning a fuel with an oxidant for the fuel comprising a first chamber for receiving one of the fuel and the oxidant, the first chamber having an outlet port, a second chamber at least partly within the first chamber for receiving the other of the fuel and oxidant and having an aperture providing communication between the interior of the second chamber and the outlet port and arranged for directing said other of the fuel and oxidant from the second chamber towards the said outlet port, obturating means operable to obturate the outlet port for preventing the passage of fuel through the outlet port, and means for passing a deposit-removing reactant to whichever one of the first and second chambers receives the fuel.

Preferably, the first chamber is adapted for receiving the fuel and the second chamber is adapted for receiving the oxidant, at least part of the first and second chambers being relatively movable, said obturating means comprising separable cooperable surfaces of the first and second chambers which obturate the outlet port when the first and second chamber are so relatively moved as to bring the surfaces into cooperable engagement.

The second chamber preferably comprises a part in the form of a duct which is mounted for movement, at least partly within the first chamber, towards and away from the outlet port. The said cooperable surfaces are preferably provided respectively at the downstream end of the said duct and on the first chamber around the outlet port.

The duct is movable by means operable from outside the chamber, and said means may be comprised at least in part by means operable to direct supplementary or auxillary fuel through the aperture of the second chamber and the outlet port of the first chamber so that apparatus can be employed to burn auxillary fuel when the combustible gas supply to the outlet port from the first chamber is interrupted by cooperation of the said cooperable surfaces.

The apparatus preferably comprises means operable to regulate the flow of oxidant through the second chamber by varying the cross-sectional flow area therethrough.

Preferably, means are provided to impart a swirling motion to oxidant passing through the second chamber, and in arrangements wherein the second chamber is so supported as to be spaced from the interior of the first chamber so that oxidant can pass through the separating space, means for imparting a swirling motion to oxidant passing through the space between the second chamber and the interior of the first chamber.

The deposit-removing reactant injection means preferably comprises at least one conduit open to the first chamber adjacent to the outlet port, preferably obliquely or substantially tangentially to the interior of the first chamber for directing at least some of the deposit-removing reactant around the internal surface of the first chamber.

In yet another aspect, the invention provides fuel combustion equipment comprising conversion means for converting a fuel to a hot combustible gas, a plurality of burners for burning the hot combustible gas with an oxidant, respective conduits for conducting the hot combustible gas from the conversion means to the burners, each burner comprising an outer chamber of substantially circular cross-section for receiving the hot combustible gas, which outer chamber has an outlet port to one side thereof substantially co-axial with the axis of the outer chamber, an inner chamber having a part of substantially circular cross-section which is at least partly within and coaxial with, the outer chamber, said part being mounted for movement within the outer chamber towards and away from the outlet port and having an entrance for oxidant at one end remote from the outlet port and an exit for oxidant at the other end adjacent to the outlet port, means for moving said part towards and away from the outlet port for varying the flow area for hot combustible gas between the first chamber and the said other end of the movable part for varying the flow of hot combustible gas to the outlet port, the movable part having a surface in the vicinity of its said other end which is cooperable with a surface of the first chamber, when the said part is moved towards the outlet port, to close the said flow area for hot combustible gas, and a duct for the passage into the first chamber of a deposit-removing reactant for removing deposits from the first chamber and/or at least part of the respective conduit through which hot combustible gas is supplied to the burner.

Figure 2:
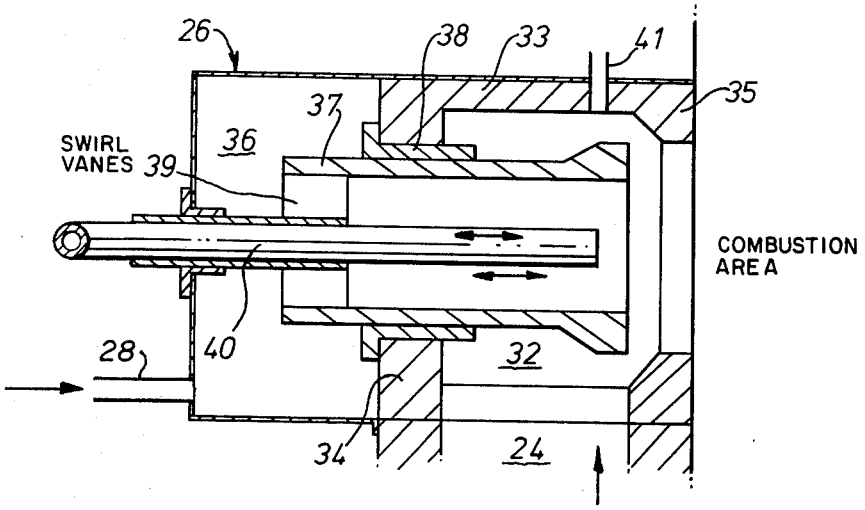
Figure 3:
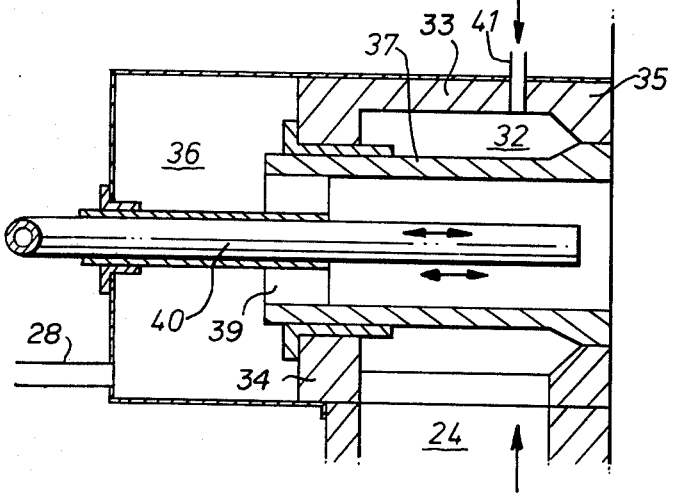
Figure 4:
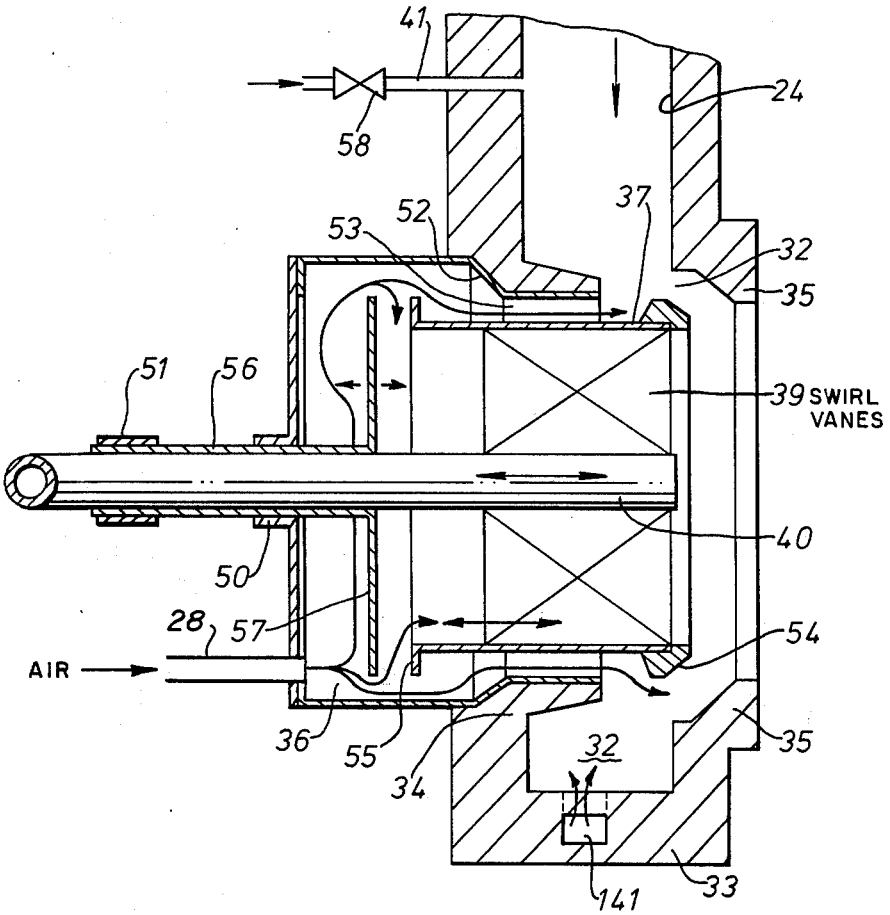

By way of illustration, non-limitative embodiments of the invention are now described with reference to the accompanying drawings in which:

FIG. 1 shows, diagrammatically, the principal parts of a plant for producing a substantially sulfur-free fuel gas, FIG. 2 is a cross-section through a burner, according to the invention, for use in the plant of FIG. 1, FIG. 3 is a cross-sectional view of the burner of FIG. 2 when arranged for the removal of deposits, and FIG. 4 is a cross-sectional view of another burner in accordance with the invention.

In FIG. 1, there is shown a gasifier vessel 10 containing a bed 11 of calcium oxide-containing particles (e.g. burned limestone or dolomite) supported on an air distributor 12 spaced above the base of the vessel 10. A sulphur containing fuel is injected into the bed 11 from one or more injectors 13 and gasified at temperatures of e.g. 800° to 1100°–1200° C at pressures ranging from sub-atmospheric to atmospheric up to superatmospheric (e.g. 10–12 atmospherics) by part-combustion with air passed into bed 11 at a rate sufficient to fluidize the particles, the air being supplied via the distributor 12 from an air duct 14. The sulphur of the fuel is fixed as calcium sulphide and other solid compounds of sulphur in the bed 11, and hot substantially sulphur-free gas containing pyrolyzable hydrocarbons, tarry materials and entrained bed fines passes out of the vessel 11 via a number (two being shown) of ducts 15. Sulphide-containing bed particles are transferred from the bed 11 to a regenerator bed 16 by one or more ducts 17 where they are fluidized by air from conduit 18, which air passes into the bed 16 via a distributor 19. The sulphides are converted to sulphur oxides (mainly $SO_2$) and calcium oxide is exothermically regenerated at e.g. 800° C to 1100° C. Regenerated particles are returned to the bed 11 by one or more ducts 20. Gasification plant of this type is more fully described in U.K. Patent Specification No. 1,336,563.

The hot fuel gas in ducts 15 is passed into cyclones 21, 22 to remove coarser entrained solids, these being rejected via diplegs 23, and the fuel gas is then passed via ducts 24, 25 into respective burners 26, 27, where it is mixed with air from lines 28, 29, and burned to provide heat for a steam raising plant 30. The resulting flue gas is vented to atmosphere via flue 31.

It will be appreciated that tarry and carbonaceous material will deposit in the ducts 15, the cyclones 21, 22, and ducts 24, 25 and that such deposition will increase the pressure drop throughout the plant, reduce the efficiency of the cyclones and promote the deposition of fine solids in the ducts and cyclones.

FIG. 2 shows, in vertical cross-section, the principal parts of the burner 26 of FIG. 1. The burner comprises a first chamber 32 which receives fuel gas from duct 24, the chamber 32 being defined by a refractory wall 33, the left-hand end of which has an inwardly turned lip 34, the right-hand end having an inturned wall portion 35, which defines a generally convergent outlet from the chamber 32. A second chamber 36 receives air from the duct 28 (FIG. 1), and the air passes from the chamber 36 into the region of the convergent outlet via an axially movable conduit 37. The conduit 37 is movable in a fixed sleeve 38 and has internal swirl vanes 39 for imparting rotational motion to the air so that good mixing of the air with fuel gas takes place in the vicinity of the convergent outlet. Combustion of the mixture is preferably to the right of the convergent outlet.

The movable conduit 37 is moved by a tube 40 attached at its left-hand end to a manual or mechanical moving mechanism (not shown). The tube 40 is adapted for use as a fuel injector, as discussed below, and extends almost to the right-hand end of the conduit 37.

When it is desired to remove deposits comprising carbonaceous and/or tarry materials, the conduit 37 is moved to the right so that, as shown in FIG. 3, the right-hand end obturates the outlet by registering against the inturned wall portion 35. In this position, air may pass directly from the chamber 36 via the interior of the conduit 37 to the right-hand end of the burner 26, but fuel gas cannot pass beyond the chamber 32. An oxidizing gas (air, steam, $CO_2$ or mixtures containing at least two of the foregoing) is passed into the chamber 32 from an "air" passage 41 so that combustion under oxidizing conditions is initiated in the chamber 32, thereby removing oxidizable deposits from the chamber. As more air is passed from the passage 41, the oxidation of oxidizable deposits extends into duct 24, and thereafter into the cyclone 21, and thereafter (if necessary) into duct 15. Non-oxidizable materials such as fines from the bed 11 may, to some extent, be released from adhesion to the walls of the ducts etc. as the oxidation proceeds. The oxidation is continued until the oxidizable deposit is substantially removed. It will be appreciated that the gaseous oxidized deposit products pass back into the vessel 10 and escape via the other burner 27 (shown in FIG. 1).

When the ducts 24 and 15, and particularly the cyclone 21, have been substantially freed of oxidizable deposit, the movable conduit 37 of burner 26 is moved to the left and fuel gas is mixed with air therein and burned until a further deposit-removing operation need be performed. As necessary, a deposit removing operation is performed on the ducts and cyclone connected to the burner 27 which is a twin to burner 26. It will be seen that the deposit-removal operations can be performed without shutting down the plant of FIG. 1.

As mentioned above, the tube 40 (by which the movable conduit 37 of burner 26 is moved) is preferably adapted for use as a fuel injector. This is so that, when the burner 26 is in its inoperative position with respect to the fuel gas from the gasifier vessel 10 (as in FIG. 3), an alternative fuel may be passed through the tube 40 for admixture with swirling air at the right-hand end of tube 40 for combustion to the right of tube 40 so that during the deposit-removing operation, the burner 26 may still be employed to supply heat to the boiler 30.

The fuel injector tube 40 may also be used during normal use of the burner 26 (FIG. 2) to supplement the normal output of the burner.

In the embodiment shown in FIG. 4, the movable conduit 37 is slidably supported via the swirl vanes 39 and the tube 40 in bearings 50, 51 outside the burner and the exterior of the conduit 37 is separated from the inturned lip 34 of the refractory wall 33 by an annular gap or space 53 through which air can flow from the air chamber or register 36 to the interior of the first chamber 32 thereby reducing the amount of deposit formation on the surfaces swept by the air flow, and avoiding problems of deposits on the external surface of the conduit 37 potentially hindering the movement of the conduit 37 in bearings, such as the bearings 38 of FIGS. 2 and 3, between the inturned lip 34 and the conduit 37.

The right-hand (as shown) inturned lip 35 defining the outlet port of the burner has a convergent surface which is adapted to cooperate and seal against a divergent surface of a refractory ring 54 around the outside of the downstream end of the conduit 37. The conduit 37 is moved towards and away from this obturating position by a pneumatic, hydraulic, electric or mechanical operating device (not shown) at the left-hand end (as illustrated) of the tube 40.

When the burner is to be decoked, the air supply thereto from the chamber 36 is closed off. The conduit 37 has an outwardly turned annular flange 55 at its upstream (left-hand) end which, when the conduit 37 is moved downstream to bring the divergent surface of the refractory ring 54 into cooperation with and substantial sealing relationship against the convergent surface of the inturned lip 35, substantially closes the annular gap 53 thereby substantially preventing the passage of air therethrough from the chamber 36. A sleeve 56 is slidably mounted on the tube 40 at its upstream end, and the sleeve supports an air throttle disc 57 in the chamber upstream of the flange 55. Means (not shown) are provided for moving the sleeve 56 in the upstream and downstream directions for varying the air flow through the conduit 37. When the sleeve 56 is moved in the downstream direction until the disc 57 contacts the annular flange 55, substantially no air can pass through the conduit 37.

The burner is decoked when the gas flow from conduit 24 to the downstream outlet is interrupted by coop eration of the surfaces of the ring 54 and inturned lip 35 and when air flow through the burner is prevented by the obturation of the annular gap 53 by the flange 55 and by the closure of the conduit 37 by the cooperation of the disc 57 against the flange 55.

The decoking is effected by passing a decoking or deposit-removing reactant such as air into the burner or ducts leading thereto. In the embodiment of FIG. 4, air is passed into the duct 24, just upstream of the burner, from a duct 41 at a rate determined by a valve 58. The duct 41 may be arranged to direct the air tangentially or obliquely into the duct 24 so that the air sweeps around the periphery of the duct 24 and thereby contacts the walls thereof, so as to enhance the removal of deposit. However, such tangential or oblique air circulation is not an essential feature for efficient deposit removal, and adequate rates of decoking may be achieved using a radial duct 41 as shown in FIG. 4. The air burns initially with gas in the hot duct 24 and at the elevated temperature, decoking will proceed relatively efficiently, beginning in the vicinity of the duct 41 and thereafter progressively upstream of the location of the duct 41 until the cyclones (21, 22 in FIG. 1) and conduits 15 (FIG. 1) have been adequately freed of internal deposit. The hot, back-flowing combustion products maintain the temperature in the duct 24, cyclones, etc. sufficiently high for decoking to take place.

It will be noted that in the embodiment of FIGS. 2 and 3, the decoking or deposit-removing reactant is passed into the burner, while in the embodiment of FIG. 4, the reactant is not shown to be passed into the burner. This is because in the embodiment of FIGS. 2 and 3, the potentially deposit-forming gas contacts substantially all the interior surface of the chamber 32 and tends to deposit tars and other condensible materials, together with fluid bed fines thereon, necessitating the decoking of the interior surfaces of the chamber 32. In contrast, the arrangement of the embodiment of FIG. 4 is such that substantially all the surface of conduit 37 is swept by a current of air thereby substantially preventing deposit formation thereon, and the amount of surface of chamber 32 on which deposits can form is relatively small. Nevertheless, it might be desirable, in some cases, to provide means by which the interior of chamber 32 can be decoked, and to this end, a duct 141 for a deposit-removing reactant such as air may be provided in addition to, or as an alternative to, the duct 41. The duct 141 may be arranged to direct its deposit-removing reactant tangentially or very obliquely into the chamber 32 so that the reactant sweeps around, and contacts, the outer peripheral surfaces defining the chamber 32.

It is to be appreciated that not all the air for combustion of the hot fuel gas must be supplied to the burners 26, 27. Some of the air (the "primary air") may be supplied to the burners, and the remainder of the air (the "secondary air") necessary for complete combustion is passed into the plant 30 immediately downstream of the burners 26, 27.

We claim:

1. A method of removing deposits from fuel combustion equipment in which a fuel having a tendency to form deposits is passed from a source of the fuel to a plurality of fuel burners via flow paths comprising respective fuel conduits, comprising closing off the flow path of fuel gas to one burner at a time, and passing a deposit-removing reactant into the closed off flow path, in a direction opposite to the normal direction of flow of fuel, from a location adjacent to and upstream, of the position of closing off of the fuel flow path.

2. A method according to claim 1 in which the fuel is a hot combustible fuel gas obtained by conversion of a normally liquid or solid fuel.

3. A method according to claim 2 in which the said conversion is part combustion of the normally liquid or solid fuel in a bed of hot fluidized solids.

4. A method according to claim 3 in which the normally liquid or solid fuel is a sulphur-containing fuel and the hot fluidized solids comprise materials for fixing sulphur from the fuel in the solids whereby the resulting hot combustible fuel gas is substantially free of sulphur moieties.

5. A method according to claim 1 in which each of the said fuel flow paths includes a cyclone for removing solids from the hot combustible fuel gas.

6. Apparatus for use as at least part of burner equipment for burning a fuel with an oxidant for the fuel comprising a first chamber for receiving one of the fuel and the oxidant, the first chamber having an outlet port, a second chamber at least partly within the first chamber for receiving the other of the fuel and oxidant and having an aperture providing communication between the interior of the second chamber and the outlet port and arranged for directing said other of the fuel and oxidant from the second chamber towards the said outlet port, obturating means operable to obturate the outlet port for preventing the passage of fuel through the outlet port, and means for passing a deposit-removing reactant to whichever one of the first and second chambers receives the fuel.

7. Apparatus according to claim 6 in which the first chamber is adapted for receiving the fuel and the second chamber is adapted for receiving the oxidant, at least part of the first and second chambers being relatively movable, said obturating means comprising separable cooperable surfaces of the first and second chambers which obturate the outlet port when the first and second chambers are so relatively moved as to bring the surfaces into cooperable engagement.

8. Apparatus according to claim 7 in which the second chamber comprises means for imparting a swirling motion to oxidant passing through the second chamber.

9. Apparatus according to claim 7 in which the second chamber comprises a part in the form of a duct which is mounted for movement, at least partly within the first chamber, towards and away from the outlet port.

10. Apparatus according to claim 9 in which the cooperable surfaces are provided at the downstream end of the said duct and on the first chamber around the outlet port.

11. Apparatus according to any of claim 7 comprising means operable from outside the second chamber for moving the duct.

12. Apparatus according to claim 11 in which the duct is supported relative to the first chamber by bearing means between the outer surface of the second chamber and the interior of the first chamber.

13. Apparatus according to claim 11 in which the duct is spaced from a surrounding part of the first chamber upstream of the outlet port, whereby some oxidant can pass between the duct and the surrounding part of the first chamber, and supported by bearing means upstream of the said surrounding part of the first chamber.

14. Apparatus according to claim 13 comprising means for imparting a swirling motion to oxidant passing between the duct and the surrounding part of the first chamber.

15. Apparatus according to claim 11 in which said means for moving the duct comprises an auxillary fuel injector operable for directing auxillary fuel through the aperture of the second chamber and the outlet aperture of the first chamber.

16. Apparatus according to claim 6 in which said means for passing deposit-removing reactant comprises at least one conduit open to the first chamber.

17. Apparatus according to claim 16 in which the said conduit is open to the first chamber or duct obliquely or substantially tangentially for directing at least some of the deposit-removing reactant around the internal surface of the first chamber or duct.

18. Apparatus according to claim 17 comprising means for obturating said conduit.

19. Fuel combustion equipment comprising conversion means for converting a fuel to a hot combustible gas, a plurality of burners for burning the hot combustible gas with an oxidant, respective conduits for conducting the hot combustible gas from the conversion means to the burners, each burner comprising an outer chamber of substantially circular cross-section for receiving the hot combustible gas, which outer chamber has an outlet port to one side thereof substantially coaxial with the axis of the outer chamber, an inner chamber having a part of substantially circular cross-section which is at least partly within and coaxial with, the outer chamber, said part being mounted for movement within the outer chamber towards and away from the outlet port and having an entrance for oxidant at one end remote from the outlet port and an exit for oxidant at the other end adjacent to the outlet port, means for moving said part towards and away from the outlet port for varying the flow area for hot combustible gas between the first chamber and the said other end of the movable part for varying the flow of hot combustible gas to the outlet port, the movable part having a surface in the vicinity of its said other end which is cooperable with a surface of the first chamber, when the said part is moved towards the outlet port, to close the said flow area for hot combustible gas, and a duct for the passage into the first chamber of a deposit-removing reactant for removing deposits from the first chamber and at least part of the respective conduit through which hot combustible gas is supplied to the burner.

20. Equipment according to claim 19 in which the conduits each comprise a cyclone for removing solids from the hot combustible gas.

21. Equipment according to claim 19 in which the conversion means comprises a fluidized bed fuel gasifier.

22. Equipment according to claim 21 in which said gasifier contains a bed comprising fluidizable sulphur-fixing solids wherein the conversion of sulphur-containing fuel to substantially sulphur-free hot combustible gas is effected.

23. Apparatus according to claim 13 in which said means comprises an auxillary fuel injector operable for directing auxillary fuel through the aperture of the second chamber and the outlet aperture of the first chamber.

24. Apparatus according to claim 13 in which said means for passing deposit-removing reactant comprises at least one conduit open to a duct for supplying the fuel to the first chamber.

25. Apparatus according to claim 24 in which the said conduit is open to the first chamber or duct obliquely or substantially tangentially for directing at least some of the deposit-removing reactant around the internal surface of the first chamber or duct.

26. Apparatus according to claim 25 comprising means for obturating said conduit.

27. Equipment according to claim 20 in which the conversion means comprises a fluidized bed fuel gasifier.

* * * * *